US005553655A

United States Patent [19]

Heidler

[11] Patent Number: 5,553,655

[45] Date of Patent: Sep. 10, 1996

[54] METHOD FOR CONVEYING MOULDING BOXES AND FOUNDRY MOULDING INSTALLATION OPERATING ACCORDING TO THE METHOD

[75] Inventor: Berthold Heidler, Gernsbach, Germany

[73] Assignee: BMD Badische Maschinenfabrik Durlach GmbH, Karlsruhe, Germany

[21] Appl. No.: 105,640

[22] Filed: Aug. 13, 1993

[30] Foreign Application Priority Data

Aug. 13, 1992 [DE] Germany ..... 42 26 778.1

[51] Int. Cl.[6] ..... B22C 25/00

[52] U.S. Cl. ..... 164/29; 164/137; 164/194

[58] Field of Search ..... 164/27, 29, 18, 164/137, 169, 194

[56] References Cited

U.S. PATENT DOCUMENTS

| | | | |
|---|---|---|---|
| 2,680,270 | 6/1954 | Gedris | 164/194 |
| 3,318,365 | 5/1967 | Isaev et al. | 164/194 |
| 3,540,516 | 11/1970 | Taccone | 164/29 X |
| 3,618,668 | 11/1971 | Dupre et al. | 164/194 X |
| 3,743,004 | 7/1973 | Becke | 164/18 |
| 4,135,570 | 1/1979 | Muller | 164/194 X |
| 4,588,014 | 5/1986 | Blower et al. | 164/29 |

FOREIGN PATENT DOCUMENTS

| | | | |
|---|---|---|---|
| 2924114 | 12/1980 | Germany | 164/29 |
| 3151610 | 9/1982 | Germany . | |
| 3241288 | 5/1984 | Germany | 164/169 |
| 3345738 | 8/1984 | Germany . | |
| 4034405 | 5/1991 | Germany . | |
| 59-107767 | 6/1984 | Japan | 164/29 |
| WO89/00900 | 2/1989 | WIPO . | |

OTHER PUBLICATIONS

Patent Abstracts of Japan, vol. 6, No. 256 (M-179)(1134) 15 Dec. 1982 and JP 57-152349 Sep. 20, 1982.

*Primary Examiner*—J. Reed Batten, Jr.
*Attorney, Agent, or Firm*—Antonelli, Terry, Stout & Kraus

[57] ABSTRACT

Upper and lower boxes are conveyed in a foundry moulding installation with two parallel conveyors, in each case one moulding machine for the upper and lower boxes on one of the conveyors and transfer stations between the two conveyors. On the first transfer station, the empty upper box is removed from the empty lower box, transferred to the second conveyor and is supplied to the first moulding machine, while the empty lower box is moved on up to the second transfer station positioned between the moulding machines and transferred to an empty location on the second conveyor positioned immediately upstream of the first moulded upper box the upper box in the next working cycle is transferred into the transfer station and from there to the first conveyor, while the lower box is moved on into the second moulding machine and then into a core inserting line. The upper and lower boxes are moved on the two conveyors with a displaced conveying cycle and the same cycle length, which corresponds to the moulding box dimensions in the conveying direction.

9 Claims, 1 Drawing Sheet

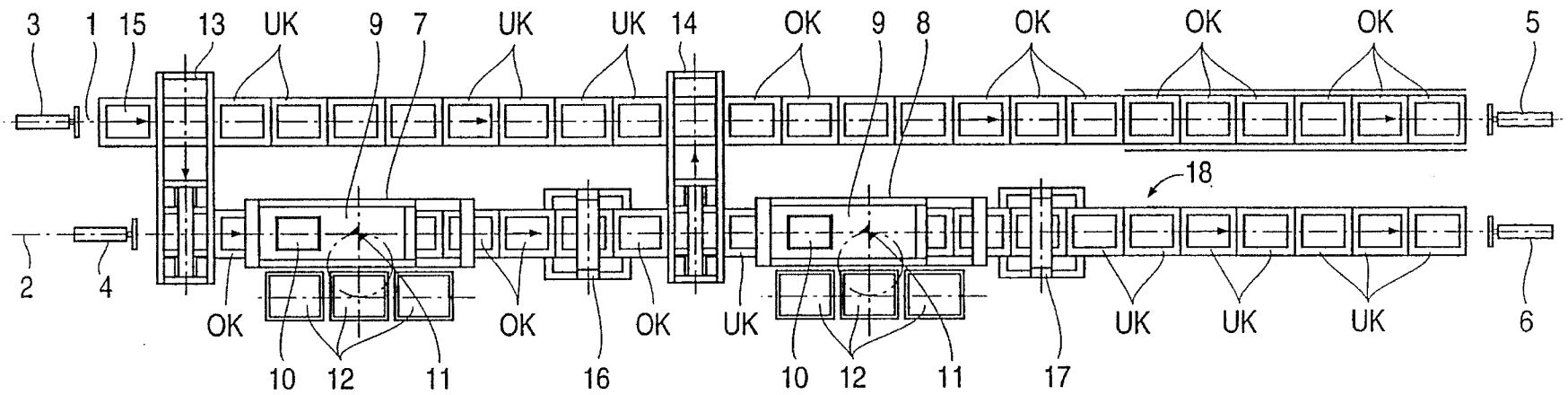
5
6
OK
OK
OK
OK
UK
UK
UK
18
17
8
9
11
12
10
14
UK
OK
16
UK
OK
7
9
11
12
10
UK
13
OK
15
1
4
3
2

METHOD FOR CONVEYING MOULDING BOXES AND FOUNDRY MOULDING INSTALLATION OPERATING ACCORDING TO THE METHOD

FIELD OF THE INVENTION

The invention relates to a method for conveying moulding boxes each comprising an upper box and a lower box in a foundry moulding installation having two parallel conveyors, with one moulding machine for the upper box and the lower box on one of the two conveyors and transfer stations for moving the upper, respectively the lower box from one conveyor to the other.

BACKGROUND OF THE INVENTION

The invention deals with moulding installations for box moulding, in which in each case one part of the mould is moulded in a lower and in an upper box and generally this takes place by compacting moulding sand using a corresponding pattern. The upper box and lower box are separately moulded and, generally after inserting cores in the lower boxes, folded together for the formation of the mould.

High capacity moulding installation (more than 120 moulds per hour) have two moulding machines. In one machine the upper box mould is produced, while the lower box mould is produced in the lower box mould. However, with the known moulding installations it is either not possible or is only possible with considerable constructional expenditure in connection with the conveying means to utilize the fundamentally possible high hourly outputs of modern moulding machines.

Known moulding installations of the aforementioned construction have two conveyors with, the moulding machines for the upper and lower boxes being arranged in spaced succession on one of the two conveyors in the conveying direction. The empty moulding box comprising the upper box and the lower box is supplied to a transfer apparatus on a first conveyor, which is normally constructed as a pallet conveyor or other construction conveyor. The transfer apparatus has two successively arranged box locations and bridges the distance to the second conveyor, which is passed through by the two moulding machines. The transfer apparatus is constructed as a double apparatus and takes over the upper box and at a lower level the lower box and moves the two box parts simultaneously to two empty locations on the second conveyor. While the empty pallets are moved on the first conveyor belt to a second transfer apparatus, the lower and upper boxes are successively supplied on the second conveyor by a sliding or thrust drive to the successive moulding machines. As on the second conveyor the upper and lower boxes constantly change and simultaneously an upper box must be moved into one moulding machine and a lower box into the other, and the feed drive on the second conveyor during each working cycle must cover a conveying path which is twice the size of a box in the conveying direction. This conveying path can be more than three meters when there is a large box spacing. The feed drive generally constituted by a hydraulic cylinder therefore has a correspondingly complicated construction. It is also necessary to control high accelerating and decelerating forces. However, for the first conveyor a much more simple sliding drive can be chosen, because it only has to cover half the conveying path.

The lower box is moulded on the first moulding machine in the conveying direction and the upper box on the second machine. The upper and lower boxes then pass into a second transfer apparatus, which returns the moulded upper box to the first conveyor, whereas the moulded lower box passes on the second conveyor into the following core inserting line. Parallel to the core inserting line the moulded upper boxes are moved on the first conveyor. As a result of this conveying principle the working cycle behind the second transfer apparatus must be again shortened to half the conveying path. This initially presupposes a braking mechanism acting against the sliding drive and a further drive in the core inserting line, while a further braking mechanism must be provided at the end of the core inserting line. It is finally pointed out that, on the first conveyor behind the second transfer apparatus there is also a funnel-shaped auger for producing holes for the pouring gate, riser, ventilating openings, etc. in the upper box mould.

In the known moulding installation the available running time is shortened by approximately half the time necessary for the conveying path for the two box parts on the second conveyor. Not only are the drives for the boxes in the second conveyor complicated and fault-prone, but also the two transfer apparatuses are different and, in particular, the first transfer apparatus for the upper and lower boxes has a very complicated construction. Finally, on the second conveyor between the two transfer apparatuses the pallets run empty, so that unnecessary motive energy is consumed in the first conveyor.

SUMMARY OF THE INVENTION

The aim of the invention is to propose a conveying method and a moulding installation allowing a complete utilization of the machine output, with the moulding installation also being constructionally and functionally simplified.

In a method of the aforementioned construction, the problem according to the invention, at the first transfer station in the conveying direction, the upper box of the empty moulding box supplied on first conveyor is separated from the lower box and only the upper box is transferred on a second conveyor with the two moulding machines and supplied to the first moulding machine, while the empty lower box is moved on the first conveyor to the second transfer station located between the moulding machines and on an empty location immediately downstream of the first moulded upper box coming from the moulding machine is transferred to the second conveyor. The first moulded upper box during the next working is moved into the transfer station and is transferred on the empty location previously taken up by the lower box to the first conveyor and is moved on there, while the lower box is moved on into the second moulding machine and then to the core inserting line, the upper box and the lower box being moved on the two conveyors with a displaced conveying cycle with the same cycle length, which corresponds to the moulding box size in the conveying direction.

Compared with the prior art, the method proposed by the invention adopts a completely new path, in that on a first portion of the first conveyor, namely, between the two transfer apparatuses, the lower boxes are conveyed and on the parallel portion of the second conveyor the upper boxes, the upper boxes being moulded in the first moulding machine. Subsequently, the upper and lower boxes alternate the conveyors, in that the moulded upper box is returned to the first conveyor, the empty lower box is transferred to the second conveyor and conveyed into the second moulding machine for moulding. Therefore, the upper and lower boxes perform a complete conveyor change.

This conveying principle also makes it possible to work on the second conveyor with the moulding machines with a simple feed, i.e. the upper boxes moved there on the first portion are only displaced by one box length during each working cycle. The same applies with regards to the lower boxes in the second portion of this conveyor. In the same manner the lower boxes are displaced on the first portion of the first conveyor and the upper boxes on its second portion only by one box length per working cycle. Thus, for both conveyors it is only necessary to have simple feed drives with a short stroke length. The essential advantage is that the shortest possible conveying stroke for a given box length leads to an optimum utilization of the capacity of the moulding machines. There is also no need for a speed reduction of the conveying path from a double to a single conveying stroke. The accelerating and decelerating forces acting on the boxes can be reduced. In addition, all the box locations on the two conveyors are constantly occupied by boxes. As a result of the simplification of the drives and their function there is necessarily also a reduction in the control expenditure for automatic operation. Finally, not only is the drive power for the first conveyor better utilized, but also that which is required at the second transfer station, because there on the outward path a lower box is transferred from the first to the second conveyor and on the return path a moulded upper box from the second to the first conveyor. Instead of this, naturally initially a moulded upper box can be transferred from the second to the first conveyor and, during the return path an empty lower box from the first to the second conveyor. As a function of the operation at the transfer station there is an empty location on one or the other conveyor. Further constructional and functional advantages occur in conjunction with the subsequently described moulding installation operating according to the method of the invention.

In order to ensure an empty location on the second conveyor in the vicinity of the second transfer station, between the two transfer stations there is an identical number of box locations and, on putting the moulding installation into operation at or downstream of the first transfer station, an upper box of the first empty moulding box is separated or only one empty upper or lower box is made ready. The displaced working cycle on both conveyors ensures that the empty location is always maintained on one of the two conveyors in the vicinity of the second transfer station.

According to a further method feature of the invention behind the first moulding machine and in front of the second transfer station, the moulded upper box is provided with holes for the pouring gate and/or riser and/or ventilating openings.

With the method according to the invention, the reworking on the first moulded upper box can take place before the second moulding machine for the lower box, so that the moulding sand occurring there can be effortlessly removed by the conveying mechanism, which extends from the moulding machine for the lower box over the moulding machine for the upper box and removes the moulding sand occurring there.

From the apparatus standpoint the invention is based on a foundry moulding installation for box moulding, comprising two parallel conveyors with sliding or pushing drives, with two moulding machines being arranged along a conveyor. Two transfer apparatuses move the upper box respectively lower box from one to the other conveyor, with the transfer mechanism, located downstream of the first moulding machine in the conveying direction, separates the upper box from the moulding box supplied empty on the first conveyor and supplies the second conveyor with the moulding machines and a core inserting line following onto said conveyor for the moulded lower boxes behind which the upper and lower boxes are folded together.

According to the invention this known moulding installation is characterized in that the first moulding machine is set up for moulding the upper box and the second moulding machine for moulding the lower box and the second transfer apparatus is located between the two moulding machines and in a first travel path the empty lower box arriving on the first conveyor is transferred to an empty location immediately downstream of the first moulded upper box on the second conveyor for conveying into the second moulding machine and, following a further conveying cycle, the moulded upper box introduced into the transfer station is transferred on the return path to the first conveyor and that the sliding or pushing drives for the first and second conveyors move the upper and lower boxes by, in each case, one box length in a time-displaced working cycle. Instead of this in the transfer apparatus of the invention on the first travel path can transfer the moulded upper box to an empty location on the first conveyor and on the return path an empty lower box onto the second conveyor.

On all the portions of the two conveyors the sliding or pushing drives only have to overcome a distance corresponding to the box length measured in the conveying direction, so that the constructional expenditure is reduced. The two transfer apparatuses can have a simpler construction. In addition, the second transfer apparatus is utilized in an optimum manner, because it performs a transfer process on both the outward and return path. In addition, only one braking mechanism is required at the end of the core inserting line, which acts counter to the sliding or pushing drive of the second conveyor. As a result of the less complicated and smaller number of drives corresponding cost savings occur. The control technology can be correspondingly simplified.

According to an embodiment of the invention, the first conveyor is a pallet conveyor and the second conveyor is a roller conveyor and the transfer apparatuses have grippers, which engage by rollers below the upper, respectively lower boxes.

It is particularly advantageous if the rollers on the gripper-like transfer apparatus are constructed in such a way that in the second conveyor they are aligned with the roller conveyor.

As indicated in conjunction with the method, the construction of the moulding installation according to the invention makes it possible to arrange a funnel-shaped auger between the first moulding machine and the second transfer apparatus.

Thus, the moulding sand occurring on the funnel-shaped auger can be discharged directly onto the conveyor belt located underneath it and which runs from the lower box to the upper box moulding machine to receive the moulding sand which occurs.

The conveyor drive for the two conveyors consists of sliding or pushing drives, preferably, hydraulic cylinders, having a working stroke corresponding to the moulding box size in the conveying direction.

At the end of the conveyor is provided, in each case a braking mechanism acting counter to the sliding or pushing drives which ensures that the boxes maintain contact with one another on each conveyor.

BRIEF DESCRIPTION OF THE DRAWING

The single FIGURE of the drawing is a schematic view of a moulding installation in accordance with the present invention.

DETAILED DESCRIPTION

The moulding installation of the present invention, as shown in the drawing, includes two parallel conveyors 1, 2 each associated with a slide or puck drawer 3, 4 and end backing mechanism 6.

The second conveyor successively passes through two moulding machines 7, 8, which have a filling vessel 10 and a compressing unit 11 on a shuttle 9 running in or counter to the conveying direction. On the operating side of the moulding machine 7, 8, once again optionally on a shuttle 9, there are several pattern plates 12 on in each case one support, which can, as required, be introduced into the moulding machine. Downstream of the first moulding machine 7 and between the first moulding machine 7 and the second moulding machine 8 is provided a transfer apparatus 13 or 14, which bridges the distance between the two conveyors 1, 2.

The empty moulding box 15, formed from the upper and lower boxes OK, UK are conveyed by the sliding or pushing drive 3 on the conveyor 1 and pass into the transfer apparatus 13, where an upper box OK is removed and transferred to the conveyor 2, whereas, the lower box UK remains on the conveyor 1. The upper box OK is conveyed by the sliding or pushing drive 4 on the conveyor 2 into the moulding machine 7, filled there with moulding sand, and the sand filling is compressed over the pattern. The moulded upper box OK passes to a funnel-shaped auger (not shown) upstream of the second transfer apparatus 14 and finally into a reversing mechanism 16, where it is reversed by 180°. There is firstly an empty location in the transfer apparatus 14 on the conveyor 2 and to it is transferred, by the transfer apparatus 14, an empty lower box from the conveyor 1. In the next operating cycle, the moulded upper box OK, arriving directly downstream of the transfer apparatus 14, is passed into the transfer apparatus 14 and, during return path, is transferred to the then empty location on the first conveyor belt 1 previously occupied by the lower box. The lower box conveyed on by one box, location, finally passes into the moulding machine 8, is filled with moulding sand from the filling vessel 10, and the sand is compressed over the pattern by a compressing mechanism 11. Behind the moulding machine 8, the moulded lower box UK passes into a reversing mechanism 17 and then onto a core inserting line 18 on the conveyor belt 2, while simultaneously, the moulded upper box OK is conveyed on the parallel portion of the conveyor 1. The upper and lower boxes OK, UK are kept in contact by the braking mechanisms 5, 6 acting counter to the sliding or pushing drives 3, 4. Behind the core inserting line 18 the upper and lower boxes OK, UK are folded together and the completed moulding box is brought to the moulding line. These details are not explained further because they are of a conventional nature.

It is clear that it is possible to work with the same sliding or pressing drives on both 1, 2, drives only having to overcome, for each working cycle, the minimum necessary conveying paths, namely, the box length. It is clear that the transfer apparatuses 13, 14 can have the simplest possible construction and that also the capacity of the transfer apparatus 14 is utilized in an optimum manner, in that the transfer apparatus 14 transfers a box on both the outward and return paths. In addition, all the portions of the two conveyors 1, 2 are occupied with boxes, so that the driving, respectively braking energy can be utilized in an optimum manner.

I claim:

1. A method for conveying moulding boxes, each comprising an upper box and a lower box, in a foundry moulding installation including first and second parallel conveyors having the same conveying direction, a first moulding machine for the upper box and a second moulding machine for the lower box disposed along the second conveyor, and first and second transfer stations for respectively transferring the upper boxes and lower boxes from one conveyor to the other conveyor, the method comprising the steps of supplying empty upper and lower moulding boxes to the first conveyor, separating the upper box from the lower box of the supplied empty moulding boxes, transferring only the upper box from the first conveyor on to the second conveyor at the first transfer station, supplying the separated upper box to the first moulding machine to form a first moulded upper box while moving the empty lower box on the first conveyor to the second transfer station positioned between the first and second moulding machines, transferring the empty lower box to an empty location on the second conveyor immediately downstream of the first moulded upper box exiting from the first moulding machine, moving the first moulded upper box in a following working cycle into the second transfer station and transferring the first moulded upper box to the first conveyor while moving the empty lower box into the second moulding machine to form a moulded lower box, and moving the moulded lower box from the second moulding machine to a core inserting line, wherein the upper and lower moulded boxes are moved on the first and second conveyors with a displaced conveying cycle having the same cycle length corresponding to a length of the moulding box, as viewed in a conveying direction of the moulding boxes.

2. A method for conveying moulding boxes, each comprising an upper box and a lower box, in a foundry moulding installation including first and second parallel disposed conveyors, a first moulding machine for the upper box and a second moulding machine for the lower box disposed along the second conveyor, and a transfer station for respectively moving the upper boxes and lower boxes from one conveyor to the other conveyor, the method comprising the steps of supplying empty upper and lower moulding boxes to the first conveyor, separating the upper box from the lower box of the supplied empty moulding boxes, transferring only the empty upper box from the first conveyor onto the second conveyor at the first transfer station, supplying the empty upper box to the first moulding machine to form a first moulded upper box, subsequently moving the first moulded upper box into the second transfer station positioned between the first and second moulding machines and transferring the moulded upper box to an empty location on the first conveyor at a position immediately downstream of a separated lower box on the first conveyor, moving the separated lower box, during a working cycle, into the second transfer station and transferring the separated lower box onto the second conveyor and into the second moulding machine to form a moulded lower box, and moving the moulded lower box to a core inserting line, wherein the upper boxes and lower boxes are moved on the first and second conveyors with a displaced conveying cycle and a same cycle length corresponding to a length of the moulding boxes, as viewed in a conveying direction of the moulding boxes.

3. A method according to claim 1 or 2, further comprising the step of providing equal number of moulding box locations, wherein, upon putting the foundry moulding installation into operation, the upper box is separated from the lower box at one of a position of the first transfer station and a position upstream of the first transfer station, as viewed in a conveying direction of the moulding boxes.

4. A method according to claim 1 or 2, providing holes in the moulded upper box for at least one of a pouring gate, riser, and ventilation in a position downstream of the first moulding machine and upstream of the second transfer station.

5. A foundry moulding installation for moulding boxes each including an upper box and a lower box, the foundry moulding installation including first and second parallel conveyors, drives for driving the first and second parallel conveyors, first and second moulding machines positioned along the second conveyor, first and second transfer stations for moving the upper and lower boxes from one conveyor to the other conveyor, wherein one of the first and second transfer stations is positioned upstream of the first moulding machine, as viewed in a conveying direction of the moulding boxes, and is adapted to separate the upper moulding boxes from the lower moulding boxes supplied on the first conveyor, and to supply the empty upper boxes to the second conveyor, the first moulding machine moulding each upper box to form a moulded upper box, the second moulding machine moulding each lower box to form a moulded lower box, the second transfer station is located between the first and second moulding machines, and each empty lower box on the first conveyor is transferred to an empty location on the second conveyor by the second transfer station at a position immediately downstream of the moulded upper box, the second transfer station transfers the moulded upper box from the second conveyor to the first conveyor following the transporting of a lower box to the second moulding machine, the drives for the first and second conveyors move in a time-displaced working cycle by, in each case, one length of the respective moulding boxes as viewed in the conveying direction of the moulding boxes, and wherein each moulded lower box is conveyed by said second conveyor to a core insert line disposed downstream of the second moulding machine, as viewed in the conveying direction of the moulding boxes.

6. A foundry moulding installation for moulding boxes each including an upper box and a lower box, the foundry moulding installation comprising first and second parallel conveyors, drives for driving the respective conveyors, first and second moulding machines located along the second conveyor, first and second transfer stations for moving the respective upper boxes and lower boxes from one conveyor onto the other conveyor, wherein one of the first and second transfer stations is positioned upstream of the first moulding machine, as viewed in a conveying direction of the moulding boxes, and is adapted to separate the upper moulding boxes from the lower moulding boxes supplied on the first conveyor, and to supply an empty upper box to the second conveyor, the first moulding machine moulding each upper box into a moulded upper box, the second moulding machine moulding each lower box into a moulded lower box, the second transfer station is located between the first and second moulding machines, the moulded upper box on the second conveyor is transferred to an empty location on the first conveyor by said second transfer station immediately downstream of a first empty lower box, each empty lower box is transferred by the second transfer station onto the second conveyor following the transfer of each moulded upper box to the first conveyor, each empty lower box is transported into the second moulding machine by the second conveyor to form the moulded lower box, the drives for the first and second conveyors are operable in a time-displaced working cycle so as to move the upper boxes and the lower boxes by, in each case, one length of the moulding boxes, as viewed in the conveying direction of the moulding boxes.

7. A moulding installation according to claim 5 or 6, wherein the first conveyor is a pallet conveyor and the second conveyor is a roller conveyor.

8. A moulding installation according to claim 5 or 6, wherein the drives for the first and second conveyors are pushing drives having a working stroke corresponding to a length of the moulding boxes, as viewed in the conveying direction of the moulding boxes.

9. A moulding installation according to claim 5 or 6, wherein breaking mechanisms are provided at an end of the first and second conveyors for applying a breaking force on the respective upper and lower boxes against a drive force of the drives for the first and second conveyors.

* * * * *